US007832088B2

(12) United States Patent
Stockin et al.

(10) Patent No.: US 7,832,088 B2
(45) Date of Patent: Nov. 16, 2010

(54) METHOD OF USING GROUNDING SYSTEM

(75) Inventors: David R. Stockin, Torrance, CA (US); Michael Esparza, Torrance, CA (US)

(73) Assignee: E & S Grounding Solutions, Inc., Torrance, CA (US)

( * ) Notice: Subject to any disclaimer, the term of this patent is extended or adjusted under 35 U.S.C. 154(b) by 465 days.

(21) Appl. No.: 11/975,039

(22) Filed: Oct. 16, 2007

(65) Prior Publication Data

US 2008/0173461 A1 Jul. 24, 2008

Related U.S. Application Data

(62) Division of application No. 11/009,300, filed on Dec. 10, 2004, now Pat. No. 7,282,637.

(51) Int. Cl.
*H01R 43/00* (2006.01)

(52) U.S. Cl. ..... 29/825; 174/6; 174/7; 361/212

(58) Field of Classification Search ..... 29/825; 174/6–7; 361/212
See application file for complete search history.

(56) References Cited

U.S. PATENT DOCUMENTS

| | | | | |
|---|---|---|---|---|
| 186,286 | A | 1/1877 | Vermilya | |
| 938,137 | A | 10/1909 | Goetz | |
| 2,065,184 | A | 12/1936 | Heinrich | |
| 3,548,069 | A | 12/1970 | Watanabe | |
| 3,716,649 | A | 2/1973 | Smith | |
| 4,087,945 | A * | 5/1978 | Berntsen et al. | 52/103 |
| 4,502,258 | A * | 3/1985 | Rushing | 52/103 |
| 4,577,053 | A | 3/1986 | Kies | |
| 4,626,330 | A | 12/1986 | Farmer | |
| 4,688,969 | A | 8/1987 | Bruser et al. | |
| 5,148,641 | A | 9/1992 | Rushing et al. | |
| 5,653,069 | A | 8/1997 | Dziedzic | |
| 6,234,260 | B1 | 5/2001 | Coast et al. | |
| 6,930,239 | B1 * | 8/2005 | Chen | 174/7 |
| 2002/0018698 | A1 | 2/2002 | Lolli et al. | |

FOREIGN PATENT DOCUMENTS

| | | | |
|---|---|---|---|
| JP | 2000195580 | A | 7/2000 |

* cited by examiner

*Primary Examiner*—C. J Arbes
(74) *Attorney, Agent, or Firm*—Cislo & Thomas, LLP; Kelly W. Cunningham

(57) ABSTRACT

A method for using a segmented grounding system, including a bit including a coupling portion at a first end, and a generally tapered second end, a shaft with a first end configured to couple to the coupling portion of the bit, and a second end comprising a receiving structure, and a tool configured to couple to the receiving structure of the second end of the shaft.

11 Claims, 4 Drawing Sheets

METHOD OF USING GROUNDING SYSTEM

CROSS REFERENCES TO RELATED APPLICATIONS

This utility patent application is a division of U.S. patent application Ser. No. 11/009,300 filed Dec. 10, 2004 for GROUNDING SYSTEM, now. U.S. Pat. No. 7,282,637.

BACKGROUND

"Grounding" is the art of making an electrical connection to the earth. This ground connection may actually be the interface with earth, and through that interface, the grounded system may be in electrical contact with the whole earth. Through that interface may pass electrical "events" to and from the connected system(s). These electrical "events" may include power from the utility, communications, phone, radio, and other forms of data, among others.

The character of this interface may determine the effectiveness of its function, i.e., how "good" is the interface and/or is there a reliable, year-round connection to earth. The effectiveness of an interface may be assessed in terms of its true DC resistance to Mother Earth. However, there may be another factor of greater concern, that is, the transient response or surge impedance, or the effective inductance of that interface. This factor will determine the effectiveness of that interface for such functions as lightning grounds, RF grounds, electric utility protection equipment grounds, and personnel safety under "ground faulting" conditions.

The earth interface system is an important subsystem. The blind application of standards with little reference to the site character or the effect of seasonal changes may not yield an effective ground interface.

When the earth interface system has not been properly engineered, significant system equipment damage may persist, personnel safety may be impaired, and system performance may be less than ideal.

Finally, the trend toward microelectronics may make electrical and electronic systems even more sensitive to any form of anomalous electrical transients. Grounding the earth interface must now be considered a vital function and must be engineered for each site and/or system individually.

Grounding systems perform at least one of the following functions:

1. A Ground, or Earth Reference Electrode.

Every electrical or electronic system must be referenced to the earth. This is referred to as "grounding." The grounding point in that system provides a common reference point for circuits within the system. In many cases, the resistance to earth of that reference point may be of little significance. For these systems a Common Point Ground (CPG) may satisfy the functional requirements. These systems may be totally self-contained or autonomously operated systems, requiring little or no external interfaces, and may present little or no potential for a compromise of personal safety. This form of grounding system, the CPG, mandates a separate connection from each element in the system to that CPG, preferably via a separate path. A simple example of this CPG is a single computer terminal where the green wire in the power plug is the ground reference.

2. The Lightning Neutralization Ground.

Lightning protection grounding system requirements have conventionally been thought to be similar to the preceding ground reference, however, they may be quite different. A more descriptive title would be: "Lightning Charge Neutralization System". This may come about because of the nature of atmospheric electricity and the lightning strike mechanism. Storm clouds induce an image charge of equal, but opposite potential, in the earth beneath the cloud. When a lightning channel terminates on an earthen object, that channel forms a conductive path between the two bodies to permit equalization of the charge between them. Since the charge is induced on the surface of the earth, it follows that all of that charge must move from where it was induced, to a strike channel terminus, in order to neutralize the charge between earth and that cloud. All this may happen in approximately 20 microseconds or so. If a facility to be protected from damage from a lightning strike is part of the charged body or is the terminus of the strike, its grounding system must provide a low resistance, low surge impedance path from any point in the system to any other point in the system where the strike may terminate. Therefore, the grounding requirement for lightning protection may not just be a low DC resistance to ground, but may be an interconnecting ground network that electrically interconnects every vulnerable component of the plant or system of concern with a low surge impedance path.

3. A Universal System.

The universal grounding system may require a near perfect interface with the earth. That is, the lower the effective resistance between that system ground point and true earth, the better, safer, or more effective the system may be. This requirement may be usually associated with systems that have many interfaces with other systems, or the "outside world." Typical examples may include the electrical utility industry, the telephone central office and large industrial plants, among others. These same systems may require a common point grounding (CPG), a lightning neutralization capability, and a low impedance interface with earth; thus providing a universal grounding (or earth) interface.

Some grounding drive rods come in various lengths, such as 8', 10', and 20', with the 10' lengths being the most common. They may be installed by being pounded into the ground using anything from a sledgehammer to a jackhammer. A standard driven rod may look like a giant nail, pointed at the tip, with the remainder being a smooth shaft. There may be no top piece of metal for hammering similar to that of a nail.

Some standard driven rods may work well if the soil is soft and moist, however. If the soil is hardpan or rocky, or if other impediments are within the soil, a standard driven rod may not work well for a number of reasons. First, when pounding a standard driven rod into the ground, and a rock or an obstruction is encountered, a standard rod may bend or break trying to get around the obstruction. Furthermore, there may be rod refusal, which means no matter how much force is applied, it may be impossible to drive a standard rod any further onto the soil.

This may be of concern when driving standard rods that are longer than 10'. In order to have a standard driven rod longer than 10', two standard 10' rods may be coupled together to achieve the desired length. Many standard rods may be connected together using a coupler that may be larger in diameter than the diameter of the rod. This may mean that if the ground rod is ⅝", the coupler may be ¾" in diameter, which may make it more difficult to drive the ground rod into the soil. This added diameter may make the rod almost impossible to drive into the earth. This may also compound problems, as codes and/or regulations may require that there be a minimum of 8' of ground rod in the ground, or sometimes as much as 10' or 20' to meet certain grounding requirements.

If this occurs, the only options may be to cut off the rod, cover it up and start again, or try to find an alternative way to drive the rod past the hard-pan soil or obstruction. This process may be very labor intensive and time consuming, and may add to the material costs needed. Unfortunately, a contractor installing the ground rods may have no choice; as the rod may have to be driven to meet the requirements set forth by design, city, state, or federal regulations and/or codes.

In soils such as, but not limited to permafrost and the like, ground rods may be pushed out of the soil and/or may be very difficult to install. Furthermore, to meet codes and other requirements, standard ground rods may have to be coupled together, then cut off to achieve the proper resistance to ground.

What is needed is a versatile grounding system that may be relatively easy to ship, install, and use. Furthermore, what is needed is a grounding system that may enhance the electrical properties of the system, may be configured to be installed in soil with impediments, and may be more likely to remain in the soil during changing soil conditions.

SUMMARY

The present invention is a method for using a segmented grounding system, including a bit including a coupling portion at a first end, and a generally tapered second end, a shaft with a first end configured to couple to the coupling portion of the bit, and a second end comprising a receiving structure, and a tool configured to couple to the receiving structure of the second end of the shaft.

DETAILED DESCRIPTION

The detailed description set forth below in connection with the appended drawings is intended as a description of exemplary embodiments and is not intended to represent the only forms in which these embodiments may be constructed and/or utilized. The description sets forth the functions and the sequence of steps for constructing and operating the exemplary embodiments. However, it is to be understood that the same or equivalent functions and sequences may be accomplished by different embodiments that are also intended to be encompassed within the spirit and scope of this disclosure.

Figure 1:
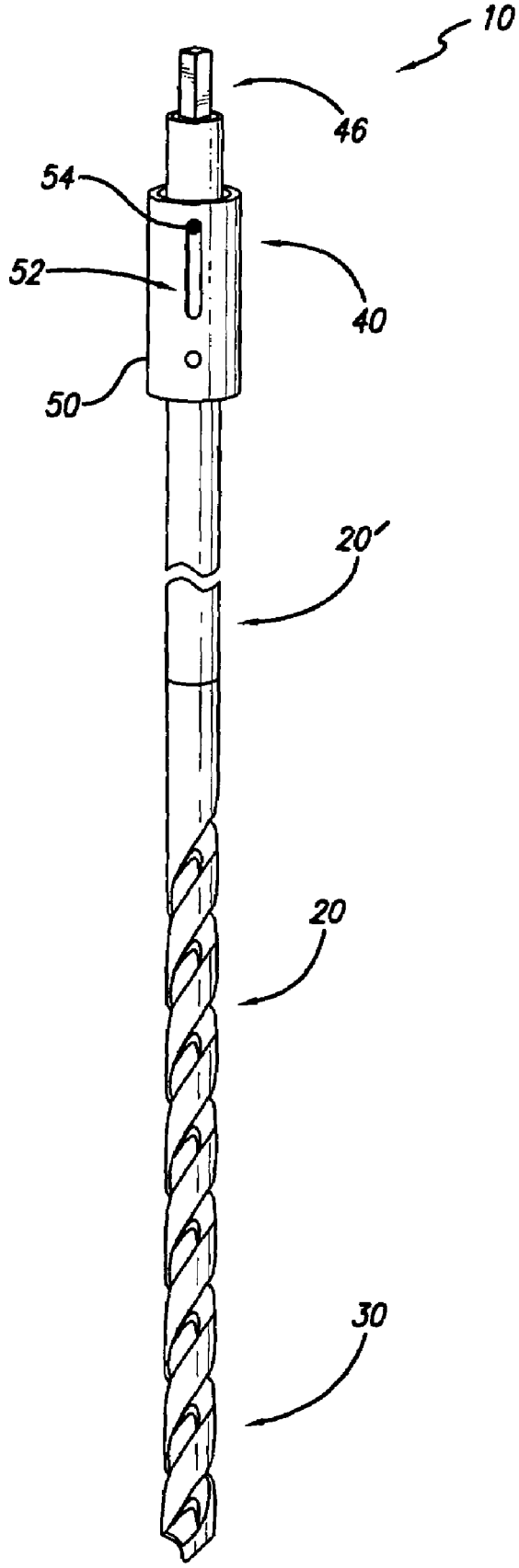
FIG. 1 is a perspective view of a grounding system according to an exemplary embodiment.

A grounding system, according to an exemplary embodiment, is shown in FIG. 1, generally at 10. System 10 may include a shaft 20 as well as bit 30. Furthermore, system 10 may include a tool 40 which may be configured to operatively couple to a shaft 20 at one end. The other end of tool 40 may be configured to couple to another tool or drive mechanism to impart rotational, and/or vertical, and/or horizontal forces upon a shaft 20 such that the shafts may be forced into the ground or other surface and/or material, as desired. Shafts 20 along with bit 30 may make up a ground rod, such that a ground rod may be rotationally and/or vertically, and/or horizontally driven into the ground.

Tool 40 may include a drive coupling structure 46, which may be configured to couple to a drive mechanism such as a drill, ratchet-type wrench, hammer drill, or other tool, as desired. Furthermore, tool 40 may include a sleeve 50 which may extend over a portion of a shaft 20, which may help secure the coupling of tool 40 to shaft 20. Tool 40 may also include a channel 52 and a stop 54, which may be operatively coupled to allow sleeve 50 to extend over a portion of a shaft 20. Sleeve 50 may also relieve side stress and strain due to the driving of the system into the ground. With this configuration, the coupling between tool 40 and shaft 20 may be enhanced such that the tool may impart forces upon a shaft 20.

With this modular configuration, installation of ground rods may be completed more quickly, easily and less expensively than currently available methods and devices. Bit 30 may be a masonry bit or other bit, such that it would penetrate rocks and/or other impediments in the soil, such that the segmented ground rod system may be secured and forced into the ground. With this versatile, modular configuration, a segmented system can be sent via mail, UPS, FedEx.

Furthermore, due to the relative short length of each segment, a first shaft 20 may be driven into the ground, and then a second shaft 20 may be coupled to the first shaft, and this method can be repeated thereby eliminating any need for ladders during installation and the other safety risks associated with having to drive a single, long shaft into the ground. The coupling of shafts 20 may be at a diameter not exceeding the diameters of the shafts 20. With this configuration, the shafts 20 may more readily enter the soil than if the coupling was larger than either of the shaft diameters.

Typically when ground rods are installed, a portion of the ground rod(s) must be driven into the ground until there is a certain resistance between the ground rod and the actual soil, such as 5 ohms. With this segmented configuration, segments may be added until the 5-ohm or lower threshold is reached. Shaft 20 and bit 30 may be cold drawn steel with $^{10}/_{1000}{}^{th}$ inch copper coating, which may be less corrosive and may increase the electrical conductivity.

Figure 2:
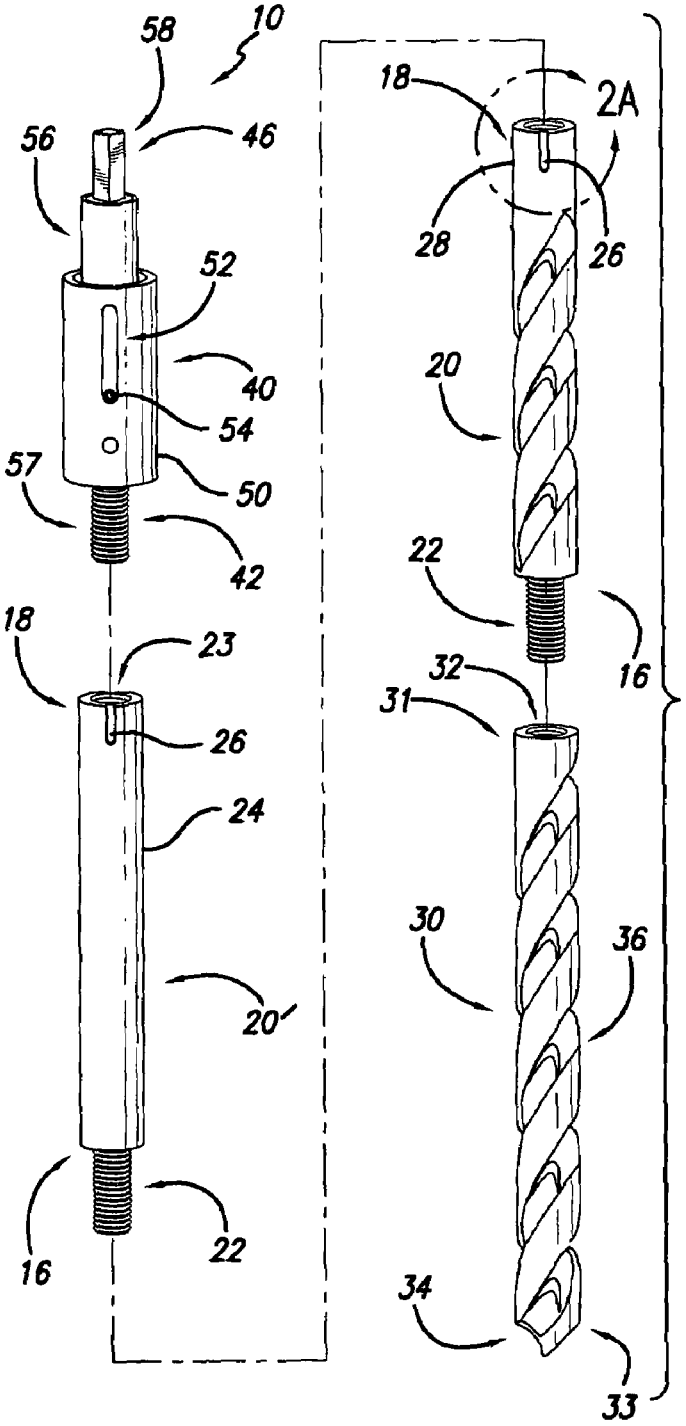
FIG. 2 is an exploded view of the exemplary embodiment of FIG. 1.

FIG. 2 is an exploded view of the embodiment shown in FIG. 1, again generally at 10. Again system 10 may include a shaft 20 as well as bit 30 and tool 40. Tool 40 may further include a shaft coupling structure 42 which may be configured to couple to a shaft 20, to facilitate forcing it into the soil.

Shaft 20 includes a first end 16 and a second end 18. Shaft 20 may further include a body 24 as well as a coupling structure 22 and a receiving structure 23. Body 24 in this embodiment is shown as being smooth, similar to current ground rods, but it may be fluted as described below. Coupling structure 22 and receiving structure 23 may be configured to couple to corresponding portions of other shafts 20 as well as to bit 30 and to tool 40. Although coupling structure 22 and receiving structure 23 are shown as threaded and tapped portions, generally male and female-type, it will be appreciated that other coupling structures may be utilized, as desired, without straying from the concepts disclosed herein, such as tapered surface for friction fitting, and/or compression fitting, etc. Coupling structure 22 and receiving structure 23 may be non-removable, permanent and irreversible for underground connections to other shaft(s) 20 yet removably coupled to a drive tool 40, as described further herein. Furthermore, it will be appreciated that bit 30 may include a male-type coupling portion, which may be configured to couple to a corresponding structure of shaft 20.

Shaft 20 may also include a groove 26 and a setscrew 28. Setscrew 28 may be one method and/or structure to insure that the coupling between shafts is permanent and irreversible. It will be appreciated that other methods and structures may be utilized for creating a permanent and irreversible coupling, as desired. Furthermore, shaft 20 may include a groove 26, which may have a corresponding post (not shown) on tool 40 to impart rotational and/or vertical, and/or horizontal force through tool 40 to shaft 20. It will be appreciated that although in this embodiment a groove and post configuration is utilized for imparting forces, other drive and force imparting configurations may be utilized, as desired, without straying from the concepts disclosed herein.

Bit 30 may have a first end 31 and a second end 33. Furthermore, bit 30 may include a tip 34 which may be generally tapered to facilitate bit 30 rotating and driving into soil and other materials, such as rocks and other impediments. Furthermore, bit 30 may include fluting 36 such as common drill bits, to facilitate rotationally and/or vertically, and/or horizontally driving the bit into soil, and through other impediments in the soil. It will be appreciated that although a common type drill bit configuration is shown, other configurations may be utilized, as desired.

Bit 30 may further include a coupling portion 32 which may be configured to couple to a corresponding portion of shaft 20. Again, this coupling may be permanent and irreversible for underground connections. Although a thread and tapped configuration is shown, it will be appreciated that other coupling configurations may be utilized, as desired, in keeping within the scope of the methods and structures disclosed herein.

Tool 40 includes a body portion 56. Body portion 56 may have a first end 57 and a second end 58. Tool 40 may further include a shaft coupling structure 42 adjacent first end 57, and a drive coupling structure 46 adjacent the second end 58. Shaft coupling structure 42 may be configured to couple to a shaft 20. Drive coupling structure 46 may be configured to couple to a drive tool (not shown).

Figure 2A:
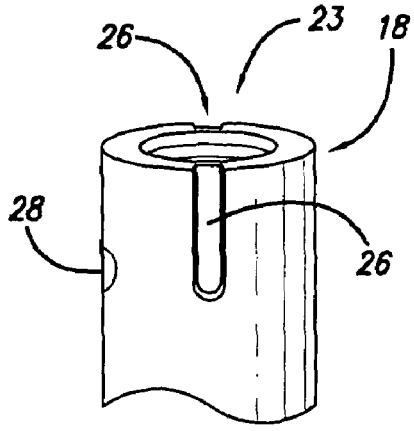
FIG. 2A is a more detailed view of a portion of a shaft according to an exemplary embodiment.

FIG. 2A is a more detailed view along line 2A as shown in FIG. 2. A more detailed perspective view of second end 18 of shaft 20 is shown. As shown, a groove 26 may be located on opposite sides of shaft 20. It will be appreciated that other configurations and numbers of grooves may be utilized, as desired. Furthermore, a drilled and tapped setscrew 28 is shown, which may make the coupling between shafts permanent and/or irreversible. Also shown is receiving portion 23 which in this embodiment is a generally female-type tapped portion that corresponds to coupling structure 22 of shaft 20. It will be appreciated that other coupling configurations may be utilized, as desired.

Figure 3:
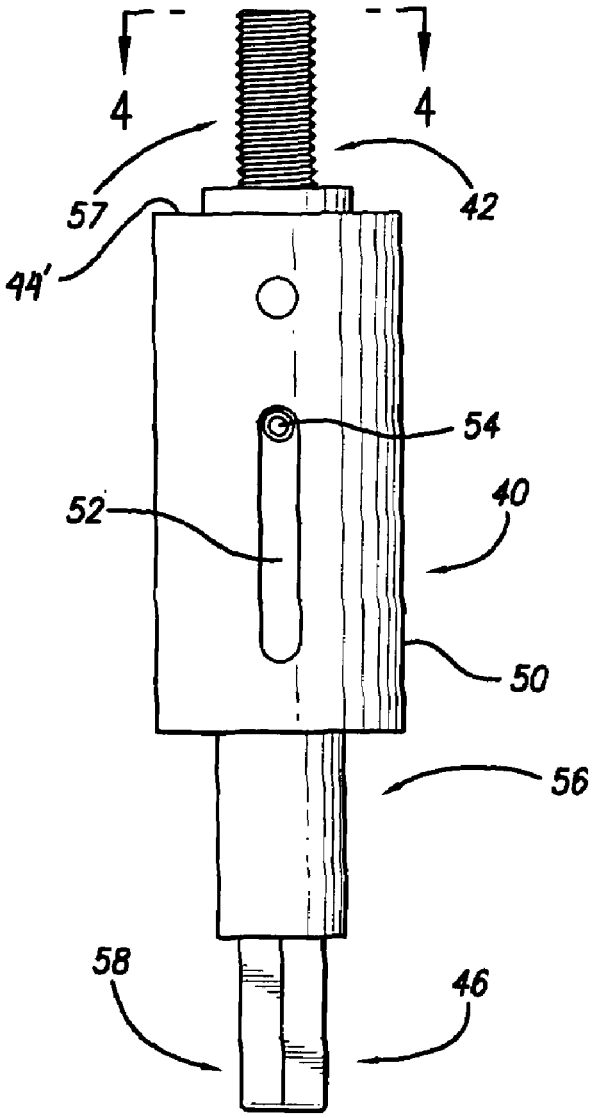
FIG. 3 is a plan view of a tool according to an exemplary embodiment.

FIG. 3 shows a close-up view of a tool 40, according to one exemplary embodiment. Again tool 40 may include a shaft coupling structure 42, in this instance a threaded rod, and a drive coupling structure 46, which may be configured to operatively couple to another drive tool, as described above. Shaft coupling structure 42 may be configured to couple to a shaft 20. Drive coupling structure 46 may be configured to couple to a drive mechanism (not shown). Tool 40 may include a sleeve 50 that may be slidably coupled to body portion 56.

Figure 4:
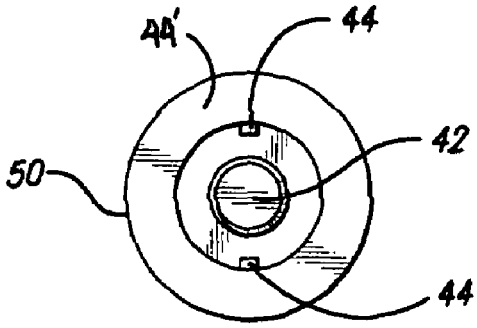
FIG. 4 is a cut-away view along line 4-4 of FIG. 3.

FIG. 4 is a cut-away view along lines 4-4 of FIG. 3. As can be seen in FIGS. 2 and 4, the shaft coupling structure 42 will operatively couple to a corresponding structure of shaft 20. Tool 40 may include one or more second shaft coupling structures 44 such as posts which may be coupled to and/or adjacent to sleeve 50. Furthermore, structure or post 44 may be configured to slidably couple to grooves 26, as shown in FIG. 2A. Furthermore, this configuration will allow sleeve 50 to extend over shaft 20 to relieve side stress as well as to dissipate other stresses, which may enhance the coupling and drive abilities of tool 40. With this configuration, rotational, vertical, and/or horizontal force may be transferred from a drive mechanism (not shown), through tool 40 to a shaft 20. It will be appreciated that, although posts 44 are shown as a pair of posts generally opposite one another, other numbers and configurations may be utilized, as desired. For instance, under certain ground conditions, the shaft 20 may be driven into the ground more reliably or more efficiently by the application of a driving force in the direction of the axis of the shaft than the rotary driving force described elsewhere herein. To account for such instances, the bottom face 44' of tool 40 could be configured to be an alternative or an additional second shaft coupling structure to impart this axial force on the top face of the shaft 20, and groove 26 could additionally include a cross-groove along at least a portion of the circumference of the shaft 20 such that posts 44 could be positioned within the cross-groove. With this configuration, the tool 40 would be driven axially, imparting a direct axial force on shaft 20 without significant rotary motion being imparted on shaft 20 and on tool 40.

Figure 5:
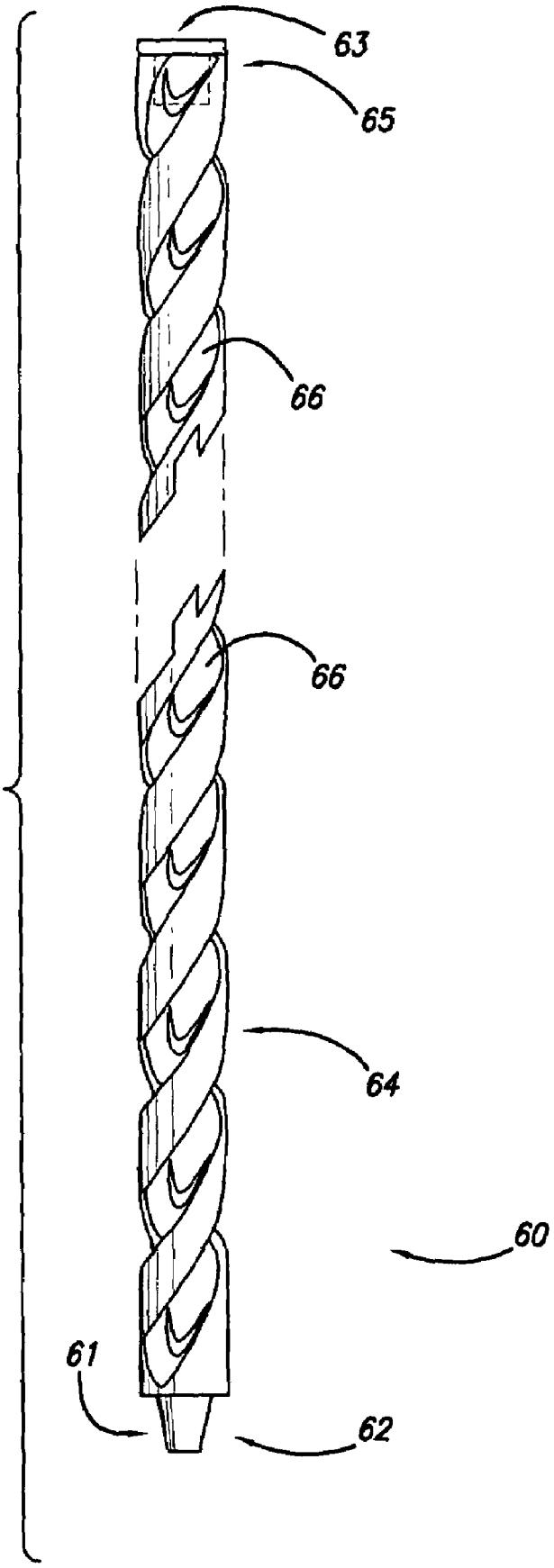
FIG. 5 is a perspective view of a shaft according to an exemplary embodiment.

FIG. 5 shows another embodiment of a shaft, generally at 60, which may have a first end 61, as well as a second end 65. Shaft 60 may further include a coupling structure 62 and a receiving structure 63, which may be configured to couple to corresponding structures of other somewhat similar shafts. In this embodiment, the coupling configuration may be generally male and female-type compression-type fittings, which may be permanent and irreversible. Again it will be appreciated that other coupling configurations may be utilized, as desired.

Shaft 60 may include a body portion 64 with fluting 66. Fluting 66 may make the shaft stronger, as well as easier for the shafts to be driven into the ground. Yet further, the fluting 66 may enable the shaft to stay in the ground in areas where the ground temperatures change and/or where the ground temperatures and conditions are such that a ground rod may be pushed out of the ground, such as areas where permafrost is the soil, as well as other areas where the type of soil and temperature changes and soil types, among other things, cause ground rods to be pushed back out of the soil.

Shaft 60, as well as shaft 20, may include a body portion 64 with fluting 66. Fluting 66 may make the shaft stronger, as well as easier for the shafts to be driven into the ground. Yet further, the fluting 66 may enable the shaft to stay in the ground in areas where the ground temperatures change and/or where the ground temperatures and conditions are such that a ground rod may be pushed out of the ground, such as areas where permafrost is the soil, as well as other areas where the type of soil and temperature changes and soil types, among other things, cause ground rods to be pushed back out of the soil.

Disclosed embodiments may be superior to the standard driven rod in electrical effectiveness and installation costs. While exemplary embodiments may greatly reduce the costs of installation, it may be manufactured at rates only slightly higher, or below that of standard driven rods, and may even be less costly to the consumer due to reduced shipping costs. The installation tool may be inexpensive and reusable tool. Additional benefits may include the inherent ability of the rod to be installed in difficult rocky terrain, permanently frozen soil, or even straight through solid concrete, among others.

Furthermore, the use of many short rods, which may permit closer spacing in an area, may be desirable. Furthermore, this configuration may provide a lower resistance to ground than a lesser number of longer ground rods. This may make this system very versatile and less expensive to use and install.

Grounding in permafrost or in areas with deep frost lines may require a special form of grounding. When the temperature is well below freezing, the resistivity of the local soil increases by factors of 10 to 1000 or more. Under these conditions, conventional grounding techniques may be impractical. Use of explosives in the form of "Shaped Charges" or augured holes may be the only reasonable solution to facilitate the implanting of a grounding rod and/or electrode in permafrost. The larger the diameter and the deeper the hole, the better the grounding interface. In every case, a conductive, low freezing point backfill may be required. These extraneous measures may not be required with the disclosed embodiments.

In closing, it is to be understood that the embodiments described herein are illustrative of the principles of the present disclosure. Other modifications that may be employed are within the scope of this disclosure. Thus, by way of example, but not of limitation, alternative configurations may be utilized in accordance with the teachings herein. Accordingly, the drawings and descriptions are illustrative and not meant to be a limitation thereof.

What is claimed is:

1. A method of providing a grounding system, comprising:

a. providing a plurality of segmented ground rod shafts:

b. inserting into the ground a first ground rod shaft having a mating end comprising a coupling surface bound by a first shaft diameter;

c. coupling a second ground rod shaft to said first ground rod shaft, the second ground rod shaft having a mating end comprising a coupling surface bound by a second shaft diameter substantially equal to said first shaft diameter, said coupling comprising fitting a male-type coupling structure on one of the two coupling surfaces into a female-type coupling structure on the other of the two coupling surfaces without any portion of any coupling structure exceeding the radial dimension of either the first or second diameter, thereby reducing the force required to drive the plurality of shafts into the ground, increasing the conductivity between the ground and the shafts, reducing the need to insert any back filler substances, and reducing the chance that the shafts will be pushed back up out of the ground by fluctuating ground temperatures;

d. inserting said second ground rod shaft into the ground; and e. repeating steps c and d until the inserted ground rod shafts together reach a predetermined desired length.

2. The method of claim 1, further comprising coupling a bit to said first ground rod shaft.

3. The method of claim 1, wherein at least one of the first and second ground rod shafts is generally fluted.

4. The method of claim 1, wherein said coupling comprises an irreversible mechanical and electrical connection between said first and said second ground rod shaft.

5. The method of claim 1, further comprising coupling a drive tool to said first ground rod shaft and to a drive device.

6. The method of claim 5, further comprising inserting a portion of a drive tool into a groove in said first ground rod shaft for imparting a driving force on said shaft to drive said shaft said into the ground.

7. A method of providing a grounding system, comprising:

a. providing a plurality of segmented ground rod shafts;

b. coupling one end of a first ground rod shaft to one end of a second ground rod shaft comprising forming or fixing a male-type mating structure on the coupling end of one of the two shafts wholly contained within the diameter of the coupling end of said shaft, forming or fixing a female-type mating structure on the coupling end of the other of the two shafts wholly contained within the diameter of the coupling end of said other shaft, and firmly mating the male-type mating structure to the female-type mating structure, without any mating structure exceeding the radial dimension of the diameter of either coupling end, thereby increasing the conductivity between the ground and the shafts and reducing the force required to drive the plurality of shafts into the ground, the need to insert any back filler substances, and the chance that the shafts will be pushed back up out of the ground by fluctuating ground temperatures;

c. inserting said first ground rod shaft into the ground;

d. inserting said second ground rod shaft into the ground; and e. coupling and insert additional ground rod shafts into the ground until the inserted ground rod shafts together reach a predetermined desired length.

8. The method of claim 7, further comprising coupling a bit to said first ground rod shaft.

9. The method of claim 7, wherein at least one of the first and second ground rod shafts is generally fluted.

10. The method of claim 7, wherein said coupling comprises an irreversible mechanical and electrical connection between said first and said second ground rod shaft.

11. The method of claim 7, further comprising coupling a drive tool to said first ground rod shaft and to a drive device.

* * * * *